US005703600A

United States Patent [19]

Burrell et al.

[11] Patent Number: 5,703,600

[45] Date of Patent: Dec. 30, 1997

[54] MICROSTRIP ANTENNA WITH A PARASITICALLY COUPLED GROUND PLANE

[75] Inventors: Dennis A. Burrell, Bedford; James Talmage Davis, II, Fort Worth, both of Tex.; Mauricio Flores, Lake Worth, Fla.

[73] Assignee: Motorola, Inc., Schaumburg, Ill.

[21] Appl. No.: 643,442

[22] Filed: May 8, 1996

[51] Int. Cl.[6] ..... H01Q 1/38

[52] U.S. Cl. ..... 343/700 MS; 343/702; 343/846

[58] Field of Search ..... 343/702, 700 MS, 343/846, 848; H01Q 1/38, 1/32

[56] References Cited

U.S. PATENT DOCUMENTS

| | | | |
|---|---|---|---|
| 3,605,104 | 9/1971 | Weston et al. | 343/848 |
| 4,658,266 | 4/1987 | Doty, Jr. | 343/848 |
| 5,181,025 | 1/1993 | Ferguson et al. | 343/700 MS |
| 5,220,335 | 6/1993 | Huang | 343/700 MS |
| 5,386,214 | 1/1995 | Sugawara | 343/700 MS |
| 5,410,749 | 4/1995 | Siwiak et al. | 343/700 MS |
| 5,420,596 | 5/1995 | Burrell et al. | 343/848 |
| 5,483,246 | 1/1996 | Barnett et al. | 343/846 |
| 5,559,521 | 9/1996 | Evans et al. | 343/846 |

*Primary Examiner*—Michael C. Wimer
*Assistant Examiner*—Tan Ho
*Attorney, Agent, or Firm*—Pablo Meles

[57] ABSTRACT

A microstrip antenna (10) comprises a planar antenna radiating element (12) having at least a first major surface and a ground plane having a first major surface (16), a second major surface (18), and a third major surface (20) substantially parallel to each other. A dielectric material (14) is positioned between the planar antenna radiating element and the ground plane. The microstrip antenna further includes a first gap (36) between the first major surface (18) of the ground plane and the second major surface (16) of the ground plane and a second gap (72) between the second major surface (16) of the ground plane and the third major surface (20) of the ground plane, wherein the first and second gaps create an increased impedance bandwidth and a lower operating frequency antenna.

18 Claims, 2 Drawing Sheets

MICROSTRIP ANTENNA WITH A PARASITICALLY COUPLED GROUND PLANE

FIELD OF THE INVENTION

This invention relates in general to microstrip antennas, and more specifically to radio communication device using a microstrip antenna with a parasitically coupled ground plane.

BACKGROUND OF THE INVENTION

It is well-known that there has been a long-continued trend toward miniaturization of portable radio communication devices. This trend is especially important in devices that are designed to be portable or worn on a user's body.

A problem that must be overcome is that miniature housings required for miniature radio communication devices leave little space for a required antenna. For example, wrist-worn receivers that attach to the user by a partially conductive wrist band and operate in a VHF radio frequency band near 150 MHz have typically used tiny ferrite core antennas in combination with the wrist band itself as a loop antenna. While this technique has performed well for the VHF band, it is not well suited for the much higher UHF and 900 MHz bands in use today that may further require a larger impedance bandwidth. Typically, to obtain the required operating frequency and impedance bandwidth required for such devices operating in the 900 Mhz bands, a thicker antenna with a thicker dielectric must be used. This presents a road block in the march towards miniaturization. Thus, a need exists for a smaller and thinner microstrip antenna that can operate in the higher bands and further maintain a relatively large impedance bandwidth.

SUMMARY OF THE INVENTION

In a first aspect of the present invention, a microstrip antenna comprises a planar antenna radiating element, a ground plane having at least a first major surface substantially parallel to a second major surface, a dielectric material positioned between the planar antenna radiating element and the ground plane and a gap between the first major surface of the ground plane and the second major surface of the ground plane, wherein the first major surface is parasitically coupled to the second major surface creating an increased impedance bandwidth and a lower operating frequency antenna.

In a second aspect of the present invention, a selective call transceiver comprises a microstrip antenna having a planar antenna radiating element, a ground plane having at least a first major surface substantially parallel to a second major surface, a dielectric material positioned between the planar antenna radiating element and the ground plane and a gap between the first major surface of the ground plane and the second major surface of the ground plane, wherein the first major surface is parasitically coupled to the second major surface creating an increased impedance bandwidth and a lower operating frequency antenna. The selective call transceiver further comprises a primary receiver element mechanically coupled to the second major surface of the ground plane for mechanically supporting the primary receiver element and a feeder electrically coupled between the planar antenna element and the receiver element for feeding the intercepted radio signal therebetween for down conversion by the receiver element, wherein the feeder is positioned such that the feeder passes through an aperture in the ground plane and in the dielectric material, wherein the receiver element also demodulates an intercepted radio signal after down conversion to derive an information signal.

DESCRIPTION OF THE PREFERRED EMBODIMENT

Figure 1:
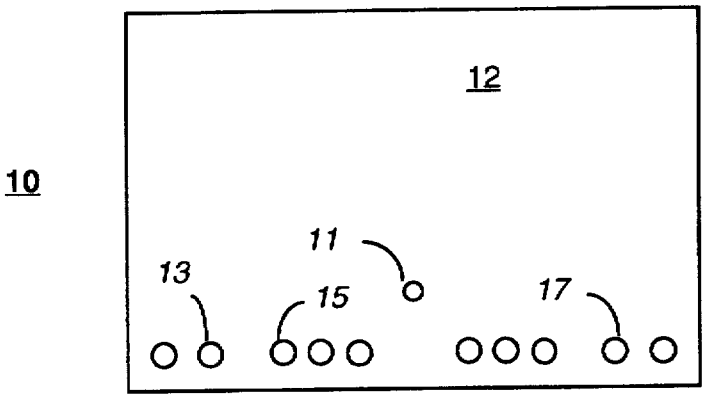
FIG. 1 is an orthographic top view of a microstrip antenna in accordance with the present invention.
Figure 2:
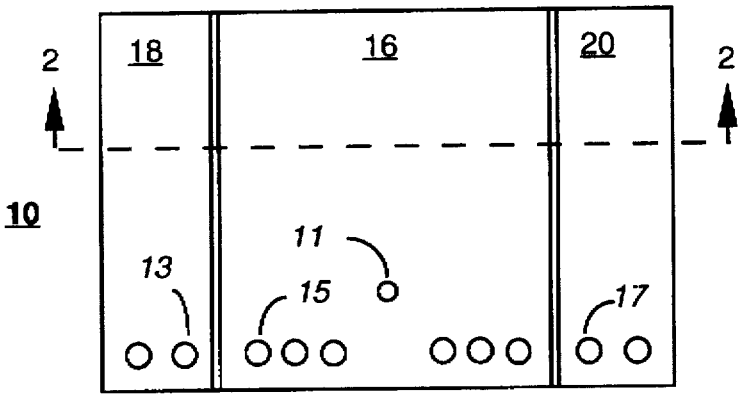
FIG. 2 is an orthographic bottom view of a microstrip antenna ground plane in accordance with the present invention.
Figure 3:
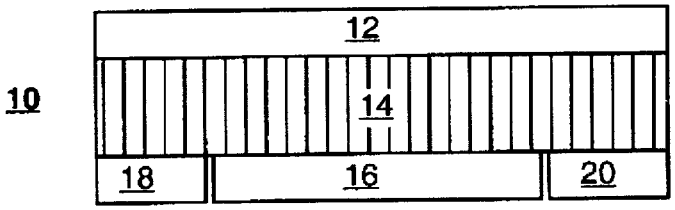
FIG. 3 is a cut view of a microstrip antenna in accordance with the present invention.

Referring to FIGS. 1, 2 and 3, an orthographic top view, an othographic bottom view, and an orthographic cross-sectional view taken along the line 2—2 (of FIG. 2), respectively, of a microstrip antenna 10 in accordance with the preferred embodiment of the present invention depicts a radiating plane or planar antenna element 12 having a first surface. Also shown is a ground plane having a first surface 16, a second surface 18, and a third surface 20. The ground plane is insulated from the planar antenna element 12 by a dielectric material 14 positioned between the planar antenna element 12 and the ground plane surfaces 16, 18 and 20.

Conductive shorting elements (not shown) extend through apertures 13, 15, and 17 in the dielectric material 14 between the planar antenna element 12 and the ground plane surfaces 18, 16 and 20 respectively. In other words, the apertures 13, 15 and 17 are plated through to couple their respective ground plane with the planar antenna element 12. The walls of the conductive shorting elements are formed within the apertures 13, 15, and 17 extending between the planar antenna element 12 and the first, second, and third surfaces of the ground plane. The microstrip antenna 10 as constructed with the separate apertures 13, 15, and 17 and their respective shorting elements allow the device to serve as a quarter-wave E-field antenna. The quarter-wave antenna is advantageous for 900 MHz applications or higher requiring a miniature antenna. An aperture 11 is preferably not plated and thus useful for passing wiring between the planar antenna element 12 and the ground plane 16. For instance, the grounded shielding of a coaxial cable could be coupled to the ground plane 16 while the center conductor of the coaxial cable could pass through the unplated aperture 11 to couple to the radiating plane or planar antenna element 12.

The dielectric material is preferably made of R4003 by Rogers or other dielectric such as ultem or alumina ceramic. The material used in constructing the ground plane (16, 18, & 20), the conductive shorting elements, and the planar antenna element 12 is preferably copper, plated with silver or gold, although it will be appreciated that other conductive materials such as beryllium-copper can be utilized as well. Other conductive and dielectric materials with similar properties may be substituted above without departing from the intent of the present invention.

Figure 5:
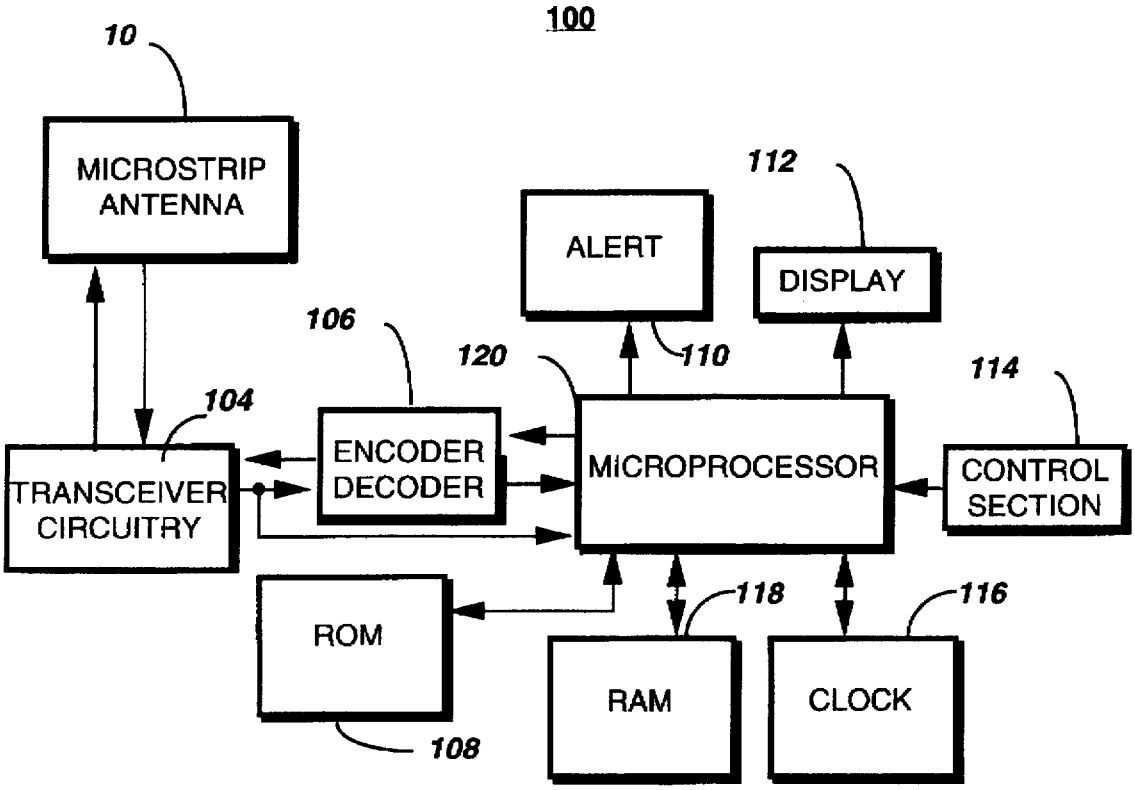
FIG. 5 is a block diagram of a selective call transceiver in accordance with the present invention.

Referring to FIG. 5, the microstrip antenna 10 of the present invention is preferably used in a selective call transceiver unit 100 that preferably comprises transceiver circuitry 104 having a conventional radio frequency (RF)

amplifier, a local oscillator, a mixer, and associated filters (all not shown) to provide a first down conversion receiver function in a manner well-known to one of ordinary skill in the art. A conventional local oscillator (not shown) is preferably included as part of the transceiver circuitry 104, and is controlled by a microprocessor 120 and an associated control section 114. A conventional encoder and decoder module 106 coupled to the transceiver circuitry 104 decodes information received at the antenna 10 and transceiver circuitry The microprocessor 114 is coupled to a read-only memory (ROM) 108 for storing executable firmware and predetermined initialization values, and to a random access memory (RAM) 118 for storing messages received. An alert device 110 is coupled to the microprocessor 120 for generating an alert in response to a received message. A control section 114 is also coupled to the microprocessor 120 to allow a user to control the operation of the selective call transceiver in a manner well-known to one of ordinary skill in the art. A real-time clock 116 is coupled to the microprocessor 120 for providing a time keeping function. A display 112, e.g., a liquid crystal display, is coupled to the microprocessor 120 for displaying messages received from the transceiver circuitry 104 and for displaying time of day information provided by the real-time clock 116. The decoder 106, the microprocessor 120, the ROM 108, the RAM 118, the alert device 110, the transceiver circuitry 104, the control section 114, the display 112, and the real-time clock 116 are conventional. The present invention has been described in detail in connection with the disclosed embodiments. The present invention can be implemented in just a transmitter or just a receiver where suitable. Further, circuits described herein could form a portion of acknowledge back receivers. These embodiments, however, are merely examples and the invention is not restricted thereto. It will be understood by those skilled in the art that variations and modifications can be made within the scope and spirit of the present invention as defined by the appended claims.

Figure 4:
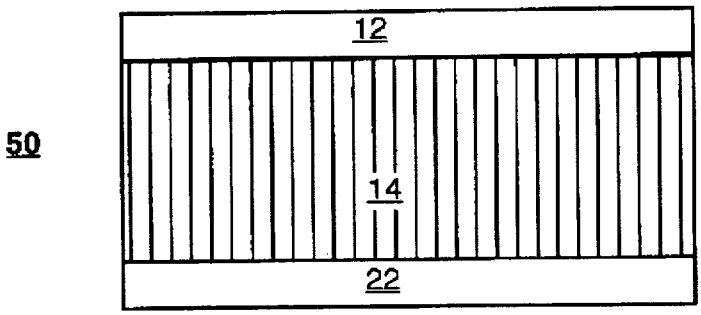
FIG. 4 (prior art)
FIG. 4 is a cut view of an existing microstrip antenna.

Referring to FIG. 4, a microstrip antenna 50 used in Motorola's Tango™ two-way pager is shown having a planar antenna element 12 and a dielectric material 14 as in the present invention with the exception that the material is thicker. Additionally, a ground plane 22 is included without any parasitic coupling. The normal ground plane limits the ability to shift the resonant frequency lower and limits the impedance bandwidth. But with the parasitically coupled ground plane of FIG. 3, the resonant frequency can be shifted lower as well as increase the impedance bandwidth. Thus, by using the parasitically coupled ground planes of the present invention, a thinner dielectric material or a cheaper dielectric material having a lower dielectric constant can be used and still obtain the same or better performance found in the existing microstrip antenna 50.

We claim:

1. A microstrip antenna, comprising:

a planar antenna radiating element having at least a first major surface;

a ground plane having at least a first major surface substantially parallel to a second major surface, wherein the first major surface and the second major surface are on the same plane;

a dielectric material positioned between the planar antenna radiating element and the ground plane; and a gap between the first major surface of the ground plane and the second major surface of the ground plane, wherein the first major surface is parasitically coupled to the second major surface creating an increased impedance bandwidth and a lower operating frequency antenna.

2. The microstrip antenna in accordance with claim 1, wherein the planar antenna radiating element, the dielectric material, the ground plane, and a conductive shorting element formed within an aperture in the microstrip antenna are constructed to serve as a quarter wave antenna.

3. The microstrip antenna in accordance with claim 1, wherein the ground plane has a third major surface substantially parallel to the second major surface of the ground plane, wherein the second major surface and the third major surface are on the same plane.

4. The microstrip antenna in accordance with claim 3, wherein a gap exists between the second major surface of the ground plane and the third major surface of the ground plane.

5. The microstrip antenna in accordance with claim 1, wherein the gap can be adjusted to modify the parasitic coupling between the first major surface and the second major surface of the ground plane to adjust the impendance bandwidth and the operating frequency of the antenna.

6. The microstrip antenna in accordance with claim 1, wherein the planar antenna radiating element and the ground plane are made of copper.

7. The microstrip antenna in accordance with claim 6, wherein the dielectric material is made of alumina ceramic.

8. The microstrip antenna in accordance with claim 6, wherein the dielectric material is made of plastic.

9. A microstrip antenna, comprising:

a planar antenna radiating element having at least a first major surface;

a ground plane having a first major surface, a second major surface, and a third major surface substantially parallel to each other and wherein the first major surface, the second major surface and the third major surface are all on the same plane;

a dielectric material positioned between the planar antenna radiating element and the ground plane;

a first gap between the first major surface of the ground plane and the second major surface of the ground plane, wherein the first major surface is parasitically coupled to the second major surface; and a second gap between the second major surface of the ground plane and the third major surface of the ground plane, wherein the first and second gaps create an increased impedance bandwidth and a lower operating frequency antenna.

10. The microstrip antenna in accordance with claim 9, wherein the planar antenna radiating element, the dielectric material, the ground plane, and a conductive shorting element formed within an aperture in the microstrip antenna are constructed to serve as a quarter wave antenna.

11. The microstrip antenna in accordance with claim 9, wherein the planar antenna radiating element and the ground plane are made of copper.

12. The microstrip antenna in accordance with claim 9, wherein the dielectric material is made of alumina ceramic.

13. The microstrip antenna in accordance with claim 9, wherein the dielectric material is made of plastic.

14. A selective call transceiver comprising:

a microstrip antenna for intercepting a radio signal comprising information, the microstrip antenna comprising:

a planar antenna radiating element having at least a first major surface;

a ground plane having at least a first major surface substantially parallel to a second major surface wherein the first major surface and the second major surface are on the same plane;

a dielectric material positioned between the planar antenna radiating element and the ground plane;

a gap between the first major surface of the ground plane and the second major surface of the ground plane, wherein the first major surface is parasitically coupled to the second major surface creating an increased impedance bandwidth and a lower operating frequency antenna, a transceiver element mechanically coupled to the second major surface of the ground plane for mechanically supporting the transceiver element; and a feeder electrically coupled between the planar antenna element and the transceiver element for feeding the intercepted radio signal therebetween for down conversion by the transceiver element, wherein the feeder is positioned such that the feeder passes through an aperture in the ground plane and in the dielectric material, wherein the transceiver element also demodulates an intercepted radio signal after down conversion to derive an information signal;

a processor coupled to the transceiver element for processing the information signal; and a display coupled to the processor for displaying information corresponding to the information signal.

15. The microstrip antenna in accordance with claim 14, wherein the planar antenna radiating element, the dielectric material, the ground plane, and a conductive shorting element formed within an aperture in the microstrip antenna are constructed to serve as a quarter wave antenna.

16. The microstrip antenna in accordance with claim 14, wherein the planar antenna radiating element and the ground plane are made of copper.

17. The microstrip antenna in accordance with claim 14, wherein the dielectric material is made of alumina ceramic.

18. The microstrip antenna in accordance with claim 14, wherein the dielectric material is made of plastic.

* * * * *